US006656899B1

(12) United States Patent
Sadlowski et al.

(10) Patent No.: US 6,656,899 B1
(45) Date of Patent: Dec. 2, 2003

(54) NONAQUEOUS LIQUID DETERGENT WITH WASH-WATER SOLUBLE LOW-DENSITY FILLER PARTICLES

(75) Inventors: Eugene Steven Sadlowski, Cincinnati, OH (US); Yousef Georges Aouad, Cincinnati, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 92 days.

(21) Appl. No.: 10/048,697

(22) PCT Filed: Aug. 8, 2000

(86) PCT No.: PCT/US00/21571

§ 371 (c)(1),
(2), (4) Date: Jan. 31, 2002

(87) PCT Pub. No.: WO01/11002

PCT Pub. Date: Feb. 15, 2001

Related U.S. Application Data

(60) Provisional application No. 60/148,054, filed on Aug. 10, 1999.

(51) Int. Cl.[7] ..... C11D 17/00
(52) U.S. Cl. ..... 510/418; 510/338
(58) Field of Search ..... 510/418, 421, 510/438, 338

(56) References Cited

U.S. PATENT DOCUMENTS 4,889,652 A * 12/1989 Sullivan et al. ..... 252/99
5,176,713 A 1/1993 Dixit et al.
5,433,884 A 7/1995 Altieri et al.
5,759,981 A 6/1998 Boutique et al.
5,814,592 A 9/1998 Kahn et al.
5,872,092 A 2/1999 Kong-Chan et al.
5,945,392 A 8/1999 Boutique et al.
6,165,959 A 12/2000 Meyer et al.
6,207,634 B1 3/2001 Meyer et al.
6,239,094 B1 5/2001 Goderis et al.
6,277,804 B1 8/2001 Kahn et al.
6,281,187 B1 8/2001 Smerznak

FOREIGN PATENT DOCUMENTS

WO WO 00/47707 8/2000

* cited by examiner

*Primary Examiner*—Yogendra N. Gupta
*Assistant Examiner*—John M Petruncio
(74) *Attorney, Agent, or Firm*—C. Brant Cook; Jerry J. Yetter; Armina E. Matthews

(57) ABSTRACT

Liquid laundry detergent conditions comprising from about 49% to about 99.95% by weight of the composition of a surfactant-containing non-aqueous liquid phase; and from about 1% to about 50% by weight of the composition of a suspended solid particulate phase comprising low-density filler particles and adjuvant detersive particles wherein the low-density filler particles are substantially insoluble in said liquid phase and are substantially soluble in a wash liquor comprising water.

13 Claims, No Drawings

NONAQUEOUS LIQUID DETERGENT WITH WASH-WATER SOLUBLE LOW-DENSITY FILLER PARTICLES

This application claims the benefit of 60/148,054 filed Aug. 10, 1999.

FIELD OF THE INVENTION

This invention relates to liquid laundry detergent products which are non-aqueous in nature and which are in the form of stable dispersions of particulate material and preferably also include other materials such as bleaching agents and/or conventional detergent composition adjuvants.

BACKGROUND OF THE INVENTION

Liquid laundry detergent products offer a number of advantages over dry, powdered or particulate laundry detergent products. Liquid laundry detergent products are readily measurable, speedily dissolved in wash water, non-dusting, are capable of being easily applied in concentrated solutions or dispersions to soiled areas on garments to be laundered and usually occupy less storage space than granular products. Because liquid laundry detergents are usually considered to be more convenient to use than granular laundry detergents, they have found substantial favor with consumers.

However, while liquid laundry detergents have a number of advantages over granular laundry detergent products, there are also disadvantages entailed in using them. In particular, laundry detergent composition components which may be compatible with each other in granular products may tend to interact or react with each other in a liquid, and especially in an aqueous liquid environment. Components such as peroxygen bleaches and bleach precursors can be especially difficult to incorporate into liquid laundry detergent products with an acceptable degree of compositional stability. Poor compositional stability may cause some active ingredients to react with each other prematurely in the product which can cause physical instabilities such as phase splitting, sedimentation and solidification. This premature reaction may also cause chemical instabilities which can lead to product discoloration or color change, oxygen gas liberation, oxidation of sensitive ingredients (especially enzymes) and eventually detersive performance loss.

One approach for enhancing the chemical compatibility and stability of liquid laundry detergent products has been to formulate non-aqueous (or anhydrous) liquid laundry detergent compositions. Generally, the chemical stability of the components of a non-aqueous liquid laundry detergent composition increase as the amount of water in the laundry detergent composition decreases. Moreover, by minimizing the amount of water in a liquid laundry detergent composition, one can maximize the surfactant activity of the composition. Non-aqueous liquid laundry detergent compositions have been disclosed in Hepworth et al., U.S. Pat. No. 4,615,820, Issued Oct. 17, 1986; Schultz et al., U.S. Pat. No. 4,929,380, Issued May 29, 1990; Schultz et al., U.S. Pat. No. 5,008,031, Issued Apr. 16, 1991; Elder et al., EP-A-030,096, Published Jun. 10, 1981; Hall et al., WO 92/09678, Published Jun. 11, 1992 and Sanderson et al., EP-A-565,017, Published Oct. 13, 1993.

However, certain common detergent ingredients such as builders and alkalinity sources (i.e. buffers) are not generally soluble in most non-aqueous solvents and because these ingredients are typically denser than the liquid matrix of a non-aqueous detergent composition, they have a tendency to separate out of liquid detergent products and form sediments on the bottom of the detergent container between their manufacture and usage by the consumer. This segregation can in turn have an adverse affect on product aesthetics, usage instructions, pourability, dispensability, stability and in particular on the overall cleaning effectiveness. These affects are accentuated when such compositions must stand for prolonged periods of times during shipping and storage.

This observed segregation and separation behavior is related to the fact that the density of the solid suspended phase is higher than the density of the liquid phase. According to Stokes' Law the rate of segregation of a solid particle suspended in a liquid medium varies proportionately with the difference between the density of the suspended particles and the density of the liquid.

Given the foregoing, there is a continuing need to incorporate solid particulates comprising ingredients which are insoluble in a non-aqueous detergent liquid (e.g. certain builders, alkalinity sources, bleach, bleach activators etc.) without undesirable separation and sedimentation by the solid particulates. Accordingly, it is a benefit of the present invention to provide non-aqueous liquid laundry detergent compositions which have excellent cleaning and detersive performance without displaying deleterious separation and segregation phenomena.

SUMMARY OF THE INVENTION

It has now been discovered in the present invention that solid particulates may be added to and suspended in a non-aqueous laundry detergent composition without undesirable separation and sedimentation of the solid particulates by including, in addition to the solid particulates, low-density filler particles which reduce the tendency of the suspended solid particulates to separate out of the laundry detergent composition and sendiment. These low-density filler particles are themselves insoluble in the non-aqueous liquid phase of the detergent composition but dissolve in the wash liquor formed when the detergent composition is mixed with water inside an automatic washing machine and then subsequently carried away in the wash liquor when it is emptied from the washing machine.

The non-aqueous liquid detergent compositions according to a first aspect of the present invention comprise from about 20% to about 99.95% by weight of the composition of a surfactant-containing non-aqueous liquid phase; and from about 1% to about 80% by weight of the composition of a suspended solid particulate phase comprising low-density filler particles and adjuvant detersive particles wherein the low-density filler particles are substantially insoluble in said liquid phase and are substantially soluble in a wash liquor. The low-density filler particles may optionally be enrobed with coating ingredients.

The present invention further encompasses a process for continuously preparing low-density filler particles which are coated with certain detergent ingredients. In the first step of the process water and adjuvant detersive components are continuously mixed to form an aqueous solution. The microspheres are made from a material which is substantially insoluble in the non-aqueous liquid phase and substantially soluble in water and have a particle size of the microspheres is less than about 100 $\mu$m. These microspheres are added to the aqueous solution to form a slurry. The slurry is then dried in a spray-dryer.

All parts, percentages and ratios used herein are expressed as percent weight unless otherwise specified. All documents cited are, in relevant part, incorporated herein by reference.

DETAILED DESCRIPTION OF THE INVENTION

Definitions—As used herein, "non-aqueous" or "anhydrous" are used synonymously and both describe a fluid in which the water content is less than about 5%.

By "wash-water" and "wash liquor" it is meant a mixture of water and the non-aqueous detergent composition taught herein. This "wash-water" and "wash liquor" is most typically contained in an automatic washing machine, but it may also be contained in a bucket, sink or any other container capable of holding a liquid.

By "wash-water soluble" or "soluble in the wash-water" or "soluble in the wash-liquor" it is meant that a particular type of material dissolves sufficiently in a wash-liquor or wash-water that the material will not be trapped and deposited as an undesirable residue on textiles or garments immersed the wash-liquor or wash-water.

By "encapsulated" and "enrobed" it is meant that the coating ingredients described below cover at least a majority of the outer surface of the low-density coated particles.

By "median" or "average" particle size it is meant the "mean" particle size in that about 50% of the particles are large and about 50% are smaller than this particle size as measured by standard particle size analysis techniques.

By "density" it is meant the density of a particle or fluid obtained by using a pyncnometer employing a low viscosity liquid or fluid.

SUSPENDED PARTICULATE SOLIDS

In addition to the surfactant-containing liquid phase (described below), the non-aqueous detergent compositions herein preferably comprise from about 1% to 80%, by weight, more preferably from about from about 5% to about 70%, by weight, most preferably from about 10% to about 50%, by weight, of suspended solid particulate material which is dispersed and suspended within the liquid phase.

A. Adjuvant Particulates

The suspended solid phase includes adjuvant particulate material which contains the adjuvant detersive components described in greater detail below. Generally such particulate material will range in size from about 0.1 to 1500 microns, more preferably from about 0.1 to 900 microns. Most preferably, such material will range in size from about 5 to 200 microns.

While the inclusion of these particles allows the formulator to included important detersive component which increase the efficacy of a detergent formulation, these particles also demonstrate a tendency to separate out from the liquid phase and form a layer of sediment on the bottom of a detergent container. To counteract this tendency, low-density filler particles (discussed in more detail below) have been included in the present invention.

The adjuvant particulate material utilized herein can comprise one or more types of detergent composition components which in particulate form are substantially insoluble in the non-aqueous liquid phase of the composition. Such materials include peroxygen bleaching agents, bleach activators, organic detergent builders, inorganic alkalinity sources and combinations thereof. The types of adjuvant particulate materials which can be utilized are described in detail, below, as follows, however, some materials can either be included in the particulate component or in the surfactant-containing non-aqueous liquid phase. Where a component could be included in either phase it has been noted.

(a) Bleaching Agent With Optional Bleach Activators

The most preferred type of adjuvant particulate material useful in the detergent compositions herein comprises particles of a peroxygen bleaching agent. Such peroxygen bleaching agents may be organic or inorganic in nature. Inorganic peroxygen bleaching agents are frequently utilized in combination with a bleach activator.

Useful organic peroxygen bleaching agents include percarboxylic acid bleaching agents and salts thereof. Suitable examples of this class of agents include magnesium monoperoxyphthalate hexahydrate, the magnesium salt of metachloro perbenzoic acid, 4-nonylamino-4-oxoperoxybutyric acid and diperoxydodecanedioic acid. Such bleaching agents are disclosed in U.S. Pat. No. 4,483,781, Hartman, Issued Nov. 20, 1984; European Patent Application EP-A-133,354, Banks et al., Published Feb. 20, 1985; and U.S. Pat. No. 4,412,934, Chung et al., Issued Nov. 1, 1983. Highly preferred bleaching agents also include 6-nonylamino-6-oxoperoxycaproic acid (NAPAA) as described in U.S. Pat. No. 4,634,551, Issued Jan. 6, 1987 to Burns et al.

Inorganic peroxygen bleaching agents may also be used in particulate form in the detergent compositions herein. Inorganic bleaching agents are in fact preferred. Such inorganic peroxygen compounds include alkali metal perborate and percarbonate materials, most preferably the percarbonates. For example, sodium perborate (e.g. mono- or tetra-hydrate) can be used. Suitable inorganic bleaching agents can also include sodium or potassium carbonate peroxyhydrate and equivalent "percarbonate" bleaches, sodium pyrophosphate peroxyhydrate, urea peroxyhydrate, and sodium peroxide. Persulfate bleach (e.g., OXONE, manufactured commercially by DuPont) can also be used. Frequently inorganic peroxygen bleaches will be coated with silicate, borate, sulfate or water-soluble surfactants. For example, coated percarbonate particles are available from various commercial sources such as FMC, Solvay Interox, Tokai Denka and Degussa.

Inorganic peroxygen bleaching agents, e.g., the perborates, the percarbonates, etc., are preferably combined with bleach activators, which lead to the in situ production in aqueous solution (i.e., during use of the compositions herein for fabric laundering/bleaching) of the peroxy acid corresponding to the bleach activator. Various non-limiting examples of activators are disclosed in U.S. Pat. No. 4,915,854, Issued Apr. 10, 1990 to Mao et al.; and U.S. Pat. No. 4,412,934 Issued Nov. 1, 1983 to Chung et al. The nonanoyloxybenzene sulfonate (NOBS), tetraacetyl ethylene diamine (TAED), and triacetin activators are typical. Mixtures thereof can also be used. See also the hereinbefore referenced U.S. Pat. No. 4,634,551 for other typical bleaches and activators useful herein.

Other useful amido-derived bleach activators are described in U.S. Pat. No. 5,891,838, issued Apr. 6, 1999 to Angell et al., and the copending provisional application of Diane Parry entitled "Non-aqueous, Liquid Detergent Compositions Containing Gasified Particulate Matter," P&G Case No. 7173P, Ser. No. 60/088,170 filed Jun. 5,1998, both of which is hereby incorporated by reference.

If peroxygen bleaching agents are used as all or part of the additional particulate material, they will generally comprise from about 1% to 30% by weight of the composition. More preferably, peroxygen bleaching agent will comprise from about 1% to 20% by weight of the composition. Most preferably, peroxygen bleaching agent will be present to the extent of from about 5% to 20% by weight of the composition. If utilized, bleach activators can comprise from about 0.5% to 20%, more preferably from about 3% to 10%, by weight of the composition. Frequently, activators are employed such that the molar ratio of bleaching agent to activator ranges from about 1:1 to 10:1, more preferably from about 1.5:1 to 5:1.

(b) Transition Metal Bleach Catalysts

Another possible type of adjuvant particulate material which can be suspended in the non-aqueous liquid detergent compositions herein comprises transition metal bleach catalysts which encourage the catalytic oxidation of soils and stains on fabric surfaces. Such compounds are present in a catalytically effective amount, preferably from about 1 ppb to about 99.9%, more typically from about 0.001 ppm to about 49%, preferably from about 0.05 ppm to about 500 ppm (wherein "ppb" denotes parts per billion by weight and "ppm" denotes parts per million by weight), of a laundry detergent composition. The transition-metal bleach catalyst comprises a complex of a transition metal selected from the group consisting of Mn(II), Mn(III), Mn(IV), Mn(V), Fe(II), Fe(III), Fe(IV), Co(I), Co(II), Co(III), Ni(I), Ni(II), Ni(III), Cu(I), Cu(II), Cu(III), Cr(II), Cr(III), Cr(IV), Cr(V), Cr(VI), V(III), V(IV), V(V), Mo(IV), Mo(V), Mo(VI), W(IV), W(V), W(VI), Pd(II), Ru(II), Ru(III), and Ru(IV) coordinated with a macropolycyclic rigid ligand, preferably a cross-bridged macropolycyclic ligand, having at least 4 donor atoms, at least two of which are bridgehead donor atoms. These catalysts are discussed with greater specificity in the copending provisional application of Daryle H. Busch et al., entitled "Catalysts and Methods for Catalytic Oxidation", having P&G Case No. 6524P, Ser. No. 60/040,629, which is hereby incorporated by reference.

(c) Other Adjuvant Materials

The adjuvant particulate material may also include other typical detersive components which can be prepared in a solid form and suspended in the non-aqueous liquid detergent compositions.

B. Low-Density Filler Particles

In addition to the above adjuvant particles, an essential component of the liquid detergent compositions of the present invention is the inclusion of low-density filler particles. When incorporated into the non-aqueous liquid detergent compositions of the present invention, the low-density filler particles reduce the tendency of the suspended adjuvant particles to separate out of the laundry detergent composition and form a sediment layer on the bottom of the detergent composition container.

Without being limited by theory there are at least two proposed explanations for how the suspended filler particles accomplished these benefits. A first explanation for the benefits provided by the low-density filler particles is that they provide a counteracting resistance to the sedimentation of the adjuvant particles. As the adjuvant particles flow downward at a rate governed by Stokes' Law they come into physical contact with the low-density filler particles which impede the adjuvant particle's their further downward movement until the adjuvant particles can migrate around the outer surface of the low-density filler particles. Thus the low-density filler particles form an obstacle field which considerably reduces the rate of sedimentation of the adjuvant particles. The detailed path that individual adjuvant particles take through this obstacle field may be calculated using an analysis based on Brownian Motion or Ising Model calculations.

Still another explanation is that a sufficient amount of the low-density filler is added to the liquid phase so that the mean, statistically weighted densities of the suspended particles and the low-density filler (when taken together) is approximately the same as the density of the liquid phase. Essentially, this means that the density of the suspended particles is matched with the density of the liquid matrix. Thus as the rate of sedimentation is directly proportional to the difference in densities between the liquid and the suspended solid phase (Stokes' Law), the rate of sedimentation is considerably reduced.

Any wash-water soluble particulate material which when added to the liquid phase reduces the tendency of the solid phase to sediment out of the laundry detergent composition is a suitable low-density filler particle. Microspheres are a preferred form of the low-density filler particle, particularly hollow microspheres, and low-density microspheres formed through the use of a liquid or gas blowing/expanding agent are particularly suitable. For further discussion of microspheres, see the entry entitled Microencapsulation" in Kirk-Othmer Encyclopedia of Chemical Technology, Third Edition, Volume 16, pages 628–651 (John Wiley & Sons, Inc., 1979), which is hereby incorporated by reference.

Additionally it is an essential part of the present invention that the low-density filler particles are made from a material which is soluble in the wash-water found in most automatic clothes washing machine; this is to insure that the particles disintegrate in the wash liquor and are not deposited as an undesirable residue on garments during the washing process. Thus it is suitable to construct the low-density filler particles from water-soluble materials. Nonetheless, the low-density filler particles may also be constructed from water-insoluble materials, provided that the non-aqueous detergent composition in which the low-density filler particles is included contains a detersive component which when released into the wash-water or wash liquor of an automatic washing machine is capable of solubilizing the material from which low-density filler particle is made. Typical detersive components which may aid the solubilization of the low-density filler particles include enzymes. In particular, materials which may be degraded and hydrolyzed in an aqueous wash liquor containing a-amylase enzymes, such as starches, are suitable as for use in the present invention.

It is important to note that while these low-density filler particles may be degraded and hydrolyzed by an aqueous wash liquor containing α-amylase enzymes, these particles will nonetheless be stable in a nonaqueous liquid detergent composition which contains insoluble α-amylase enzymes, because the α-amylase enzymes are not active in a non-aqueous environment. Upon use, the detergent composition is significantly diluted with water, thus providing the enzyme with a water environment conducive to activity and consequently the enzymes dissolve the polysaccharide particles.

There are presently several readily available commercial microsphere products such as Q-CEL™ particles (hollow microspheres made from sodium borosilicate glass) and EXPANCEL™ particles (hollow microspheres made from acrylonitrile/methacrylonitrile copolymer). These products are, however, not suitable in the present invention because they are not soluble in wash-liquors formed from typical detersive components, even a detersive component such as α-amylase enzyme.

Suitable organic materials which may be used in the present invention to construct low-density filler particles include those materials described in U.S. Pat. No. 4,124,705, to Rothman et al., issued Nov. 7, 1978, which is hereby incorporated by reference. Disclosed materials include three-dimensional networks of polysaccharides or derivatives thereof, cross-linked by means of bridges having covalent bonds. These polysaccharide networks themselves are not water-soluble, but they may be broken up into fragments and hydrolyzed by α-amylase enzymes (which are found in the present detergent compositions). The fragments produced are water-soluble and may be easily dissolved in the wash liquor. Specific examples of suitable polysaccharides include starch and glycogen and dextrins of starch and glycogen. As is described in Rothman et al., various modifications can be performed on the polysaccharides, such as dextrinization, altering the surface charge or hydrophobicity and encouraging crosslinking, in order to provide the necessary film foaming properties, solvent resistance or mechanical integrity. However, in order to insure that the polysaccharide particles are capable of being degraded by α-amylase enzymes it is generally necessary that the substitution degree of the polysaccharides with respect to the cross-linking bridge substituents and possible singly-bound substituents is lower than 70 percent, preferably less than 60 percent, wherein the substitution degree is given as the percentage of the number of substituted glucose units present.

Other suitable organic materials are those consisting of a complex polymeric matrix of cross-linked starch such as those obtained by starch fragments from hydrolyzed potato starch crosslinked and substituted with glycerol ether moieties. These occur as single as well as oligometric crosslinks of substituents. Such particles are further characterized and discussed in U.S. Pat. No. 4,124,705, which is hereby incorporated by reference. Such starch microspheres are available commerical from the Pharmacia Company under the tradename SPHEREX™.

Another suitable material from which to construct low-density filler particles is a protein capable of forming a shell around an entrapped gas or liquid (in the case of the present invention the entrapped gas or liquid may be merely a blowing agent to produce a hollow microsphere). Suitable proteins included albumin, human gamma-globulin, b-lactoglobulin and other proteins which have both hydrophillic and hydrophobic amino acids; a more extensive list of these are disclosed in U.S. Pat. No. 5,855,865, to Lambert et al., which is herein incorporated by reference.

In one embodiment of the present invention, the low-density filler particles are encapsulated with coating materials such as organic and inorganic builder material, alkalinity source material and other coating components. By so coating and enrobing the microspheres the surface characteristics, ionic strength and hydrophilicty are altered. Typically, when it is intended to coat the low-density filler particle with coating ingredients, the low-density filler particle itself is made from a material which is insoluble in pure water. This is because in the process of coating the filler particle, the particle is added to an aqueous solution of the coating ingredients and then the solution is dried in a spray-dryer. Accordingly, if the filler particle is made from water-soluble materials, then it will essentially dissolve when added to the aqueous slurry.

For greater clarification of the present invention, suitable coating ingredients are set-forth below in more detail.

(a) Inorganic and Organic Builder Material

Organic detergent builder material which serves to counteract the effects of calcium, or other ion, water hardness encountered during laundering/bleaching use of the compositions herein can be included. Examples of such materials include the alkali metal, citrates, succinates, malonates, fatty acids, carboxymethyl succinates, carboxylates, polycarboxylates and polyacetyl carboxylates. Specific examples include sodium, potassium and lithium salts of oxydisuccinic acid, mellitic acid, benzene polycarboxylic acids and citric acid. Other examples of organic phosphonate type sequestering agents such as those which have been sold by Monsanto under the Dequest tradename and alkanehydroxy phosphonates. Citrate salts are highly preferred.

Other suitable organic builders include the higher molecular weight polymers and copolymers known to have builder properties. For example, such materials include appropriate sodium salts of polyacrylic acid, polymaleic acid, and polyacrylic/polymaleic acid copolymers and their salts, such as those sold by BASF under the Sokalan trademark which have molecular weight ranging from about 5,000 to 100,000. These salts may also serve as a desiccant, moisture sink or water scavenger in the non-aqueous liquid detergent compositions herein.

Another suitable type of organic builder comprises the water-soluble salts of higher fatty acids, i.e., "soaps." These include alkali metal soaps such as the sodium, potassium, ammonium, and alkylolammonium salts of higher fatty acids containing from about 8 to about 24 carbon atoms, and preferably from about 12 to about 18 carbon atoms. Soaps can be made by direct saponification of fats and oils or by the neutralization of free fatty acids. Particularly useful are the sodium and potassium salts of the mixtures of fatty acids derived from coconut oil and tallow, i.e., sodium or potassium tallow and coconut soap.

Inorganic or P-containing detergent builders include, but are not limited to, the alkali metal, ammonium and alkanolammonium salts of polyphosphates (exemplified by the tripolyphosphates, pyrophosphates, and glassy polymeric meta-phosphates), phosphonates, phytic acid, silicates, carbonates (including bicarbonates and sesquicarbonates), sulphates, and aluminosilicates. However, non-phosphate builders are required in some locales. Importantly, the compositions herein function surprisingly well even in the presence of the so-called "weak" builders (as compared with phosphates) such as citrate, or in the so-called "underbuilt" situation that may occur with zeolite or layered silicate builders.

Examples of silicate builders are the alkali metal silicates, particularly those having a $SiO_2$:$Na_2O$ ratio in the range 1.6:1 to 3.2:1 and layered silicates, such as the layered sodium silicates described in U.S. Pat. No. 4,664,839, issued May 12, 1987 to H. P. Rieck. NaSKS-6® is the trademark for a crystalline layered silicate marketed by Hoechst (commonly abbreviated herein as "SKS-6"). Unlike zeolite builders, the Na SKS-6 silicate builder does not contain aluminum. NaSKS-6 has the delta-$Na_2SiO_5$ morphology form of layered silicate. It can be prepared by methods such as those described in German DE-A-3,417,649 and DE-A-3,742,043. SKS-6 is a highly preferred layered silicate for use herein, but other such layered silicates, such as those having the general formula $NaMSi_xO_{2+1}.yH_2O$ wherein M is sodium or hydrogen, x is a number from 1.9 to 4, preferably 2, and y is a number from 0 to 20, preferably 0 can be used herein. Various other layered silicates from Hoechst include NaSKS-5®, NaSKS-7® and NaSKS-11®, as the alpha, beta and gamma forms. As noted above, the delta-$Na_2SiO_5$ (NaSKS-6 form) is most preferred for use herein. Other silicates may also be useful such as for example magnesium silicate, which can serve as a crispening agent in granular formulations, as a stabilizing agent for oxygen bleaches, and as a component of suds control systems.

Examples of carbonate builders are the alkaline earth and alkali metal carbonates as disclosed in German Patent Application No. 2,321,001 published on Nov. 15, 1973.

Aluminosilicate builders are useful in the present invention. Aluminosilicate builders are of great importance in most currently marketed heavy duty granular detergent compositions, and can also be a significant builder ingredient in liquid detergent formulations. Aluminosilicate builders include those having the empirical formula:

$$M_z[(zAlO_2)_y].xH_2O$$

wherein z and y are integers of at least 6, the molar ratio of z to y is in the range from 1.0 to about 0.5, and x is an integer from about 15 to about 264.

Useful aluminosilicate ion exchange materials are commercially available. These aluminosilicates can be crystalline or amorphous in structure and can be naturally-occurring aluminosilicates or synthetically derived. A method for producing aluminosilicate ion exchange materials is disclosed in U.S. Pat. No. 3,985,669, Krummel, et al, issued Oct. 12, 1976. Preferred synthetic crystalline aluminosilicate ion exchange materials useful herein are available under the designations Zeolite A, Zeolite P (B), Zeolite MAP and Zeolite X. In an especially preferred embodiment, the crystalline aluminosilicate ion exchange material has the formula:

$$Na_{12}[(AlO_2)_{12}(SiO_2)_{12}].xH_2O$$

wherein x is from about 20 to about 30, especially about 27. This material is known as Zeolite A. Dehydrated zeolites (x=0–10) may also be used herein. Preferably, the aluminosilicate has a particle size of about 0.1–10 microns in diameter.

If utilized as all or part of the additional particulate material, insoluble organic detergent builders can generally comprise from about 2% to 20% by weight of the compositions herein. More preferably, such builder material can comprise from about 4% to 10% by weight of the composition.

(b)Alkalinity Sources

A further material which can form part of the coating on the low-density filler particles is a material which serves to render aqueous washing solutions formed from such compositions generally alkaline in nature. Such materials may or may not also act as detergent builders, i.e., as materials which counteract the adverse effect of water hardness on detergency performance.

Examples of suitable alkalinity sources include water-soluble alkali metal carbonates, bicarbonates, borates, silicates and metasilicates. Although not preferred for ecological reasons, water-soluble phosphate salts may also be utilized as alkalinity sources. These include alkali metal pyrophosphates, orthophosphates, polyphosphates and phosphonates. Of all of these alkalinity sources, alkali metal carbonates such as sodium carbonate are the most preferred.

The alkalinity source, if in the form of a hydratable salt, may also serve as a desiccant, moisture sink or water scavenger in the non-aqueous liquid detergent compositions herein. The presence of an alkalinity source which is also a desiccant may provide benefits in terms of chemically stabilizing those composition components such as the peroxygen bleaching agent which may be susceptible to deactivation by water.

If utilized as all or part of the additional particulate material component, the alkalinity source will generally comprise from about 1% to 25% by weight of the compositions herein. More preferably, the alkalinity source can comprise from about 2% to 15% by weight of the composition. Such materials, while water-soluble, will generally be insoluble in the non-aqueous detergent compositions herein.

(c) Other Components

The low-density coated particles may also be coated with other coating ingredients which serve both functionally detersive and structural purposes.

One example of a desirable structural ingredient is a water soluble binding agent. Alkylene aminomethylene phosphonic acids or water soluble salts thereof which can serve as an binding agent to hold together the coating materials which encapsulate the outer surface of the microsphere. As is discussed elsewhere in this application, these acids and their corresponding salts can also serve as a chelant. A preferred example of the chelant is Diethylene Triamine Penta Methyl Phosphonic Acid (DTMPA) which is available commercially under the name DEQUEST Grade 2066 from the Monsanto Company.

Other suitable binding agents include polymeric compounds such as water soluble maleic/acrylic copolymers (particularly a 40% maleic/60% acrylic blend), water soluble polyacrylates of molecular wieghts from about 2000 to about 5000 (particularly molecular weights of around 4500).

Also suitable are organic polymers such as polyethylene glycol with a molecular weight of between 1000 and 6000 and polyvinylprrolidone, particularly crosslinked polyvinylprrolidone such as those sold under the trade name POLYPLASDONE XL™ or KOLLIDON CL.™

The above materials can also serve as desiccants, moisture sinks or water scavengers when used in the non-aqueous liquid detergent.

Additionally, the materials previously mentioned under the "Adjuvant Particles" subsection are also suitable to include as coating materials for the low-density filler particles.

C. Method Aspect

The present invention also provides a method for preparing the low-density filler particles in which the particles are coated with the coating materials disclosed above. In the first step of the process, the invention entails continuously mixing and heating a slurry containing water, a selection of the coating ingredients described above and the low-density filler particles (which are preferably polysaccharide or protein microspheres, but any of the microsphere materials discussed above are suitable). Although the microspheres may be made from water-soluble materials, a significant amount of the microspheres will generally not dissolve in the presence of the water in the slurry because the water content will not be sufficiently high as to encourage solubility. Furthermore, if the solution contains high amounts of inorganic salts such as carbonates and citrates (as is likely) than the solubility of the microspheres in the slurry may be considerably decreased due to salt effects. Generally, the slurry may contain higher concentrations of water without the undesirable solvation of the water-soluble microspheres as the concentation of salt in the slurry increases.

A suitable mixer for this process step is one consisting essentially of a horizontal, hollow static cylinder having a centrally mounted rotating shaft around which several plough-shaped blades are attached. An impeller stirrer is particularly suitable.

The resulting slurry is then fed to a spray-tower. One or more spray drying techniques in one or more spray-drying towers may be used to make detergent compositions in accordance with the instant invention. In this procedure, the slurry is fed into the spray dryer and spray dried to form a dried particle which is the loww-density filler particle substantially enrobed with containing ingredients.

Any standard spray drying techniques may be used to execute the processes described herein. Many suitable spray drying techniques and spray drying equipment is discussed in K. Masters, *Sprays Drying Handbook 5th Edition*, Longman, N.Y., which is hereby incorporated by reference. The spray-dryer is operated so that the inlet temperature is from about 150° C. to about 500° C., preferably from about 180° C. to about 400° C., more preferably from about 200° C. to about 350° C. The outlet temperature should be controlled to be from about 80° C. to about 200° C., preferably from about 110° C. to about 170° C.

After spray-drying the particles are collected and added directly to the non-aqueous liquid phase of the liquid detergent composition.

In the present invention, mean particle size of the low-density filler particles (with or without coating) will be less than 100 $\mu$m, preferably from about 10 $\mu$m to about 80 $\mu$m, most preferably from about 20 $\mu$m to about 70 $\mu$m. The density of the particles (with or without coating) will be from about 0.01 g/ml to about 0.50 g/ml, preferably less than about 0.30 g/ml.

The coated low-density filler particles and the processes for producing them which are disclosed in the present invention may also be used in the manufacture of granular detergent products, particularly for use as a base granule. The use of the coated low-density filler particles in a granular detergent offers several advantages, notably narrow particle size and density distribution and an attractive uniform spherical shape. The narrow particles size distribution is particularly important because it allows more control over the granular detergent morphology and also increases the efficiency by reducing the recycling and reprocessing of fines (particulates which are too small to be included in a granular detergent) and overs (particulates which are too large to be included in a granular detergent).

After the coated low-density filler particle is formed by any of the process embodiments described above, the particles may be mixed with other detergent particles and/or dried detergent agglomerates to form a granular detergent product. The other detergent components as well as the processes for mixing, agglomerating and drying are all-well known to those skilled in the art.

Coated low-density filler particles which are intended to be used as spray-dried particles in the manufacture of a granular detergent composition may be coated with a broader variety of ingredients than those described above which are used to coat a low-density filler particle which is added to a non-aqueous liquid detergent composition; thus ingredients to coat the particle may be selected from any of the detersive components taught or disclosed either explicitly or by incorporation by reference in this invention. Most preferably the coating ingredients for the coated low-density filler particles are selected from surfactants and builders.

SURFACTANT-CONTAINING LIQUID PHASE

The surfactant-containing, non-aqueous liquid phase will generally comprise from about 49% to 99.95% by weight of the detergent compositions herein. More preferably, this liquid phase is surfactant-structured and will comprise from about 52% to 98.9% by weight of the compositions. Most preferably, this non-aqueous liquid phase will comprise from about 55% to 70% by weight of the compositions herein. Such a surfactant-containing liquid phase will frequently have a density of from about 0.6 to 1.4 g/cc, more preferably from about 0.9 to 1.3 g/cc. The liquid phase of the detergent compositions herein is preferably formed from one or more non-aqueous organic diluents into which is mixed a surfactant structuring agent which is preferably a specific type of anionic surfactant-containing powder.

(a) Non-aqueous Organic Diluents

The major component of the liquid phase of the detergent compositions herein comprises one or more non-aqueous organic diluents. The non-aqueous organic diluents used in this invention may be either surface active, i.e., surfactant, liquids or non-aqueous, non-surfactant liquids referred to herein as non-aqueous solvents. The term "solvent" is used herein to connote the non-surfactant, non-aqueous liquid portion of the compositions herein. While some of the essential and/or optional components of the compositions herein may actually dissolve in the "solvent"-containing liquid phase, other components will be present as particulate material dispersed within the "solvent"-containing liquid phase. Thus the term "solvent" is not meant to require that the solvent material be capable of actually dissolving all of the detergent composition components added thereto.

The non-aqueous liquid diluent component will generally comprise from about 50% to 100%, more preferably from about 50% to 80%, most preferably from about 55% to 75%, of a structured, surfactant-containing liquid phase. Preferably the liquid phase of the compositions herein, i.e., the non-aqueous liquid diluent component, will comprise both non-aqueous liquid surfactants and non-surfactant non-aqueous solvents.

i) Non-aqueous Surfactant Liquids

Suitable types of non-aqueous surfactant liquids which can be used to form the liquid phase of the compositions herein include the alkoxylated alcohols, ethylene oxide (EO)—propylene oxide (PO) block polymers, polyhydroxy fatty acid amides, alkylpolysaccharides, and the like. Such normally liquid surfactants are those having an HLB ranging from 10 to 16. Most preferred of the surfactant liquids are the alcohol alkoxylate nonionic surfactants.

Alcohol alkoxylates are materials which correspond to the general formula:

$$R^1\ (C_mH_{2m}O)_nOH$$

wherein $R^1$ is a $C_8$–$C_{16}$ alkyl group, m is from 2 to 4, and n ranges from about 2 to 12. Preferably $R^1$ is an alkyl group, which may be primary or secondary, that contains from about 9 to 15 carbon atoms, more preferably from about 10 to 14 carbon atoms. Preferably also the alkoxylated fatty alcohols will be ethoxylated materials that contain from about 2 to 12 ethylene oxide moieties per molecule, more preferably from about 3 to 10 ethylene oxide moieties per molecule.

The alkoxylated fatty alcohol materials useful in the liquid phase will frequently have a hydrophilic-lipophilic balance (HLB) which ranges from about 3 to 17. More preferably, the HLB of this material will range from about 6 to 15, most preferably from about 8 to 15.

Examples of fatty alcohol alkoxylates useful in or as the non-aqueous liquid phase of the compositions herein will include those which are made from alcohols of 12 to 15 carbon atoms and which contain about 7 moles of ethylene oxide. Such materials have been commercially marketed under the trade names Neodol 25–7 and Neodol 23–6.5 by Shell Chemical Company. Other useful Neodols include Neodol 1–5, an ethoxylated fatty alcohol averaging 11 carbon atoms in its alkyl chain with about 5 moles of ethylene oxide; Neodol 23–9, an ethoxylated primary $C_{12}$–$C_{13}$ alcohol having about 9 moles of ethylene oxide and Neodol 91–10, an ethoxylated $C_9$–$C_{11}$ primary alcohol having about 10 moles of ethylene oxide. Alcohol ethoxylates of this type have also been marketed by Shell Chemical Company under the Dobanol tradename. Dobanol 91–5 is an ethoxylated $C_9$–$C_{11}$ fatty alcohol with an average of 5 moles ethylene oxide and Dobanol 25–7 is an ethoxylated $C_{12}$–$C_{15}$ fatty alcohol with an average of 7 moles of ethylene oxide per mole of fatty alcohol.

Other examples of suitable ethoxylated alcohols include Tergitol 15-S-7 and Tergitol 15-S-9 both of which are linear secondary alcohol ethoxylates that have been commercially marketed by Union Carbide Corporation. The former is a mixed ethoxylation product of $C_{11}$ to $C_{15}$ linear secondary alkanol with 7 moles of ethylene oxide and the latter is a similar product but with 9 moles of ethylene oxide being reacted.

Other types of alcohol ethoxylates useful in the present compositions are higher molecular weight nonionics, such as Neodol 45–11, which are similar ethylene oxide condensation products of higher fatty alcohols, with the higher fatty alcohol being of 14–15 carbon atoms and the number of ethylene oxide groups per mole being about 11. Such products have also been commercially marketed by Shell Chemical Company.

If alcohol alkoxylate nonionic surfactant is utilized as part of the non-aqueous liquid phase in the detergent compositions herein, it will preferably be present to the extent of from about 1% to 60% of the composition structured liquid phase. More preferably, the alcohol alkoxylate component will comprise about 5% to 40% of the structured liquid phase. Most preferably, an alcohol alkoxylate component will comprise from about 5% to 35% of the detergent composition structured liquid phase. Utilization of alcohol alkoxylate in these concentrations in the liquid phase corresponds to an alcohol alkoxylate concentration in the total composition of from about 1% to 60% by weight, more preferably from about 2% to 40% by weight, and most preferably from about 5% to 25% by weight, of the composition.

Another type of non-aqueous surfactant liquid which may be utilized in this invention are the ethylene oxide (EO)—propylene oxide (PO) block polymers. Materials of this type are well known nonionic surfactants which have been marketed under the tradename Pluronic. These materials are formed by adding blocks of ethylene oxide moieties to the ends of polypropylene glycol chains to adjust the surface active properties of the resulting block polymers. EO-PO block polymer nonionics of this type are described in greater detail in Davidsohn and Milwidsky; *Synthetic Detergents*, 7*th Ed.*; Longman Scientific and Technical (1987) at pp. 34–36 and pp. 189–191 and in U.S. Pat. No. 2,674,619 and 2,677,700. All of these publications are incorporated herein by reference. These Pluronic type nonionic surfactants are also believed to function as effective suspending agents for the particulate material which is dispersed in the liquid phase of the detergent compositions herein.

Another possible type of non-aqueous surfactant liquid useful in the compositions herein comprises polyhydroxy fatty acid amide surfactants. Materials of this type of nonionic surfactant are those which conform to the formula:

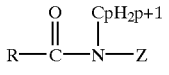

wherein R is a $C_{9-17}$ alkyl or alkenyl, p is from 1 to 6, and Z is glycityl derived from a reduced sugar or alkoxylated derivative thereof. Such materials include the $C_{12}$–$C_{18}$ N-methyl glucamides. Examples are N-methyl N-1-deoxyglucityl cocoamide and N-methyl N-1-deoxyglucityl oleamide. Processes for making polyhydroxy fatty acid, amides are know and can be found, for example, in Wilson, U.S. Pat. No. 2,965,576 and Schwartz, U.S. Pat. No. 2,703,798, the disclosures of which are incorporated herein by reference. The materials themselves and their preparation are also described in greater detail in Honsa, U.S. Pat. No. 5,174,937, Issued Dec. 26, 1992, which patent is also incorporated herein by reference.

The amount of total liquid surfactant in the preferred surfactant-structured, non-aqueous liquid phase herein will be determined by the type and amounts of other composition components and by the desired composition properties. Generally, the liquid surfactant can comprise from about 35% to 70% of the non-aqueous liquid phase of the compositions herein. More preferably, the liquid surfactant will comprise from about 50% to 65% of a non-aqueous structured liquid phase. This corresponds to a non-aqueous liquid surfactant concentration in the total composition of from about 15% to 70% by weight, more preferably from about 20% to 50% by weight, of the composition.

Also suitable for use in the present invention are low foaming surfactants, such as conventional secondary alkyl sulfate surfactants which are those materials which have the sulfate moiety distributed randomly along the hydrocarbyl "backbone" of the molecule as well as mid-chain branched surfactants which are mid-chain branched primary alkyl sulfate surfactants and mid-chain branched primary alkyl alkoxoxylated sulfate surfactants having an average of greater than 14.5 carbon atoms. The mid-chain branched surfactants are discussed in greater detail in the copending application of Malcolm Dodd et al., entitled "Processes for Making a Granular Detergent Composition Containing Mid-Chain Branched Surfactants," having P&G Case No. 6869P, Ser. No. 60/061,876, filed on Oct. 10, 1997, hereby incorporated by reference. Nonionic surfactants also generally low foaming surfactants.

ii) Non-surfactant Non-aqueous Organic Solvents

The liquid phase of the detergent compositions herein may also comprise one or more non-surfactant, non-aqueous organic solvents. Such non-surfactant non-aqueous liquids are preferably those of low polarity. For purposes of this invention, "low-polarity" liquids are those which have little, if any, tendency to dissolve one of the preferred types of particulate material used in the compositions herein, i.e., the peroxygen bleaching agents, sodium perborate or sodium percarbonate. Thus relatively polar solvents such as ethanol are preferably not utilized. Suitable types of low-polarity solvents useful in the non-aqueous liquid detergent compositions herein do include non-vicinal $C_4$–$C_8$ alkylene glycols, alkylene glycol mono lower alkyl ethers, lower molecular weight polyethylene glycols, lower molecular weight methyl esters and amides, and the like.

A preferred type of non-aqueous, low-polarity solvent for use in the compositions herein comprises the non-vicinal $C_4$–$C_8$ branched or straight chain alkylene glycols. Materials of this type include hexylene glycol (4-methyl-2,4-pentanediol), 1,6-hexanediol, 1,3-butylene glycol and 1,4-butylene glycol. Hexylene glycol is the most preferred.

Another preferred type of non-aqueous, low-polarity solvent for use herein comprises the mono-, di-, tri-, or tetra-$C_2$–$C_3$ alkylene glycol mono $C_2$–$C_6$ alkyl ethers. The specific examples of such compounds include diethylene glycol monobutyl ether, tetraethylene glycol monobutyl ether, dipropolyene glycol monoethyl ether, and dipropylene glycol monobutyl ether. Diethylene glycol monobutyl ether, dipropylene glycol monobutyl ether and butoxy-propoxy-propanol (BPP) are especially preferred. Compounds of the type have been commercially marketed under the tradenames Dowanol, Carbitol, and Cellosolve.

Another preferred type of non-aqueous, low-polarity organic solvent useful herein comprises the lower molecular weight polyethylene glycols (PEGs). Such materials are those having molecular weights of at least about 150. PEGs of molecular weight ranging from about 200 to 600 are most preferred.

Yet another preferred type of non-polar, non-aqueous solvent comprises lower molecular weight methyl esters. Such materials are those of the general formula: $R^1$—C(O)—$OCH_3$ wherein $R^1$ ranges from 1 to about 18. Examples of suitable lower molecular weight methyl esters include methyl acetate, methyl propionate, methyl octanoate, and methyl dodecanoate.

The non-aqueous, generally low-polarity, non-surfactant organic solvent(s) employed should, of course, be compatible and non-reactive with other composition components, e.g., bleach and/or activators, used in the liquid detergent compositions herein. Such a solvent component is preferably utilized in an amount of from about 1% to 70% by weight of the liquid phase. More preferably, a non-aqueous, low-polarity, non-surfactant solvent will comprise from about 10% to 60% by weight of a structured liquid phase, most preferably from about 20% to 50% by weight, of a structured liquid phase of the composition. Utilization of non-surfactant solvent in these concentrations in the liquid phase corresponds to a non-surfactant solvent concentration in the total composition of from about 1% to 50% by weight, more preferably from about 5% to 40% by weight, and most preferably from about 10% to 30% by weight, of the composition.

iii) Blends of Surfactant and Non-surfactant Solvents

In systems which employ both non-aqueous surfactant liquids and non-aqueous non-surfactant solvents, the ratio of surfactant to non-surfactant liquids, e.g., the ratio of alcohol alkoxylate to low polarity solvent, within a structured, surfactant-containing liquid phase can be used to vary the rheological properties of the detergent compositions eventually formed. Generally, the weight ratio of surfactant liquid to non-surfactant organic solvent will range about 50:1 to 1:50. More preferably, this ratio will range from about 3:1 to 1:3, most preferably from about 2:1 to 1:2.

(b) Surfactant Structurant

The non-aqueous liquid phase of the detergent compositions of this invention is prepared by combining with the non-aqueous organic liquid diluents hereinbefore described a surfactant which is generally, but not necessarily, selected to add structure to the non-aqueous liquid phase of the detergent compositions herein. Structuring surfactants can be of the anionic, nonionic, cationic, and/or amphoteric types.

Preferred structuring surfactants are the anionic surfactants such as the alkyl sulfates, the alkyl polyalkxylate sulfates and the linear alkyl benzene sulfonates. Another common type of anionic surfactant material which may be optionally added to the detergent compositions herein as structurant comprises carboxylate-type anionics. Carboxylate-type anionics include the $C_{10}$–$C_{18}$ alkyl alkoxy carboxylates (especially the EO 1 to 5 ethoxycarboxylates) and the $C_{10}$–$C_{18}$ sarcosinates, especially oleoyl sarcosinate. Yet another common type of anionic surfactant material which may be employed as a structurant comprises other sulfonated anionic surfactants such as the $C_8$–$C_{18}$ paraffin sulfonates and the $C_8$–$C_{18}$ olefin sulfonates. Structuring anionic surfactants will generally comprise from about 1% to 30% by weight of the compositions herein.

As indicated, one preferred type of structuring anionic surfactant comprises primary or secondary alkyl sulfate anionic surfactants. Such surfactants are those produced by the sulfation of higher $C_8$–$C_{20}$ fatty alcohols.

Conventional primary alkyl sulfate surfactants have the general formula $$ROSO_3\text{-}M^+$$

wherein R is typically a linear $C_8$–$C_{20}$ hydrocarbyl group, which may be straight chain or branched chain, and M is a water-solubilizing cation. Preferably R is a $C_{10\text{-}14}$ alkyl, and M is alkali metal. Most preferably R is about $C_{12}$ and M is sodium.

Conventional secondary alkyl sulfates, as described above, may also be utilized as a structuring anionic surfactant for the liquid phase of the compositions herein.

If utilized, alkyl sulfates will generally comprise from about 1% to 30% by weight of the composition, more preferably from about 5% to 25% by weight of the composition. Non-aqueous liquid detergent compositions containing alkyl sulfates, peroxygen bleaching agents, and bleach activators are described in greater detail in Kong-Chan et al.; WO 96/10073; Publiched Apr. 4, 1996, which application is incorporated herein by reference.

Another preferred type of anionic surfactant material which may be optionally added to the non-aqueous cleaning compositions herein as a structurant comprises the alkyl polyalkoxylate sulfates. Alkyl polyalkoxylate sulfates are also known as alkoxylated alkyl sulfates or alkyl ether sulfates. Such materials are those which correspond to the formula $$R^2\text{—O—}(C_mH_{2m}O)_n\text{—}SO_3M$$

wherein $R^2$ is a $C_{10}$–$C_{22}$ alkyl group, m is from 2 to 4, n is from about 1 to 15, and M is a salt-forming cation. Preferably, $R^2$ is a $C_{12}$–$C_{18}$ alkyl, m is 2, n is from about 1 to 10, and M is sodium, potassium, ammonium, alkylammonium or alkanolammonium. Most preferably, $R^2$ is a $C_{12}$–$C_{16}$, m is 2, n is from about 1 to 6, and M is sodium. Ammonium, alkylammonium and alkanolammonium counterions are preferably avoided when used in the compositions herein because of incompatibility with peroxygen bleaching agents.

If utilized, alkyl polyalkoxylate sulfates can also generally comprise from about 1% to 30% by weight of the composition, more preferably from about 5% to 25% by weight of the composition. Non-aqueous liquid detergent compositions containing alkyl polyalkoxylate sulfates, in combination with polyhydroxy fatty acid amides, are described in greater detail in Boutique et al; PCT application Ser. No. PCT/US96/04223, which application is incorporated herein by reference.

The most preferred type of anionic surfactant for use as a structurant in the compositions herein comprises the linear alkyl benzene sulfonate (LAS) surfactants. In particular, such LAS surfactants can be formulated into a specific type of anionic surfactant-containing powder which is especially useful for incorporation into the non-aqueous liquid detergent compositions of the present invention. Such a powder comprises two distinct phases. One of these phases is insoluble in the non-aqueous organic liquid diluents used in the compositions herein; the other phase is soluble in the non-aqueous organic liquids. It is the insoluble phase of this preferred anionic surfactant-containing powder which can be dispersed in the non-aqueous liquid phase of the preferred compositions herein and which forms a network of aggregated small particles that allows the final product to stably suspend other additional solid particulate materials in the composition.

Further descriptions of suitable surfactants, and methods for preparing such surfactants can be found in the copending application of Jay I. Kahn et al., entitled "Preparation of Nonaqueous, Particulate-Containing Liquid Detergent Compositions with Surfactant-Sturctured Liquid Phase", having P&G Case No. 6150, Ser. No. 09/202,964, filed on Dec. 23, 1998, which is hereby incorporated by reference.

OTHER OPTIONAL COMPOSITION COMPONENTS

In addition to the composition liquid and solid phase components as hereinbefore described, the detergent compositions herein can, and preferably will, contain various other optional components. Some of the following optional components will be found in the present compositions in the suspended solid phase, while others will be in the surfactant-rich liquid phase. The optional components may either dissolve in the liquid phase or may be dispersed within the liquid phase in the form of fine particles or droplets. Some of the other materials which may optionally be utilized in the compositions herein are described in greater detail as follows:

(a) Optional Inorganic Deterrent Builders

The detergent compositions herein may also optionally contain one or more types of inorganic detergent builders beyond those listed hereinbefore that also function as alkalinity sources. Such optional inorganic builders can include, for example, aluminosilicates such as zeolites. Aluminosilicate zeolites, and their use as detergent builders are more fully discussed in Corkill et al., U.S. Pat. No. 4,605,509; Issued Aug. 12, 1986, the disclosure of which is incorporated herein by reference. Also crystalline layered silicates, such as those discussed in this '509 U.S. patent, are also suitable for use in the detergent compositions herein. If utilized, optional inorganic detergent builders can comprise from about 2% to 15% by weight of the compositions herein.

(b) Optional Enzymes

Enzymes can be included in the formulations herein for a wide variety of fabric laundering purposes, including removal of protein-based, carbohydrate-based, or triglyceride-based stains; for the prevention of refugee dye transfer; and for fabric restoration. It is believed that the addition of the special hydrotropes described above will enhance the performance of enzymes in a detergent composition. This is because as the hydrotropes increase the rate of dissolution of the detergent composition, the rate at which enzymes come into contact with water and are activated will also increase and the corresponding detersive benefits provided by activated enzymes will also increase. This behavior is seen in both aqueous and non-aqueous detergent compositions.

The enzymes to be incorporated include proteases, amylases, lipases, mannanase, cellulases, and peroxidases, as well as mixtures thereof. Other types of enzymes may also be included. They may be of any suitable origin, such as vegetable, animal, bacterial, fungal and yeast origin. However, their choice is governed by several factors such as pH-activity and/or stability optima, thermostability, stability versus active detergents, builders and so on. In this respect bacterial or fungal enzymes are preferred, such as bacterial amylases and proteases, and fungal cellulases.

Enzymes are normally incorporated at levels sufficient to provide up to about 5 mg by weight, more typically about 0.01 mg to about 3 mg, of active enzyme per gram of the composition. Stated otherwise, the compositions herein will typically comprise from about 0.001% to about 5%, preferably 0.01%–1.0% by weight of a commercial enzyme preparation. Protease enzymes are usually present in such commercial preparations at levels sufficient to provide from 0.005 to 0.1 Anson units (AU) of activity per gram of composition.

Suitable examples of proteases are the subtilisins which are obtained from particular strains of *Bacillus subtilis* and *Bacillus licheniforms*. Another suitable protease is obtained from a strain of Bacillus, having maximum activity throughout the pH range of 8–12, developed and sold by Novo Industries A/S under the registered trade name ESPERASE®. The preparation of this enzyme and analogous enzymes is described in British Patent Specification No. 1,243,784 of Novo Industries A/S. Proteolytic enzymes suitable for removing protein-based stains that are commercially available include those sold under the tradenames ALCALASE® and SAVINASE® by Novo Industries A/S (Denmark) and MAXATASE® by International Bio-Synthetics, Inc. (The Netherlands). Other proteases include Protease A (see European Patent Application 130,756, published Jan. 9, 1985) and Protease B (see European Patent Application Serial No. 87303761.8, filed Apr. 28, 1987, and European Patent Application 130,756, Bott et al, published Jan. 9, 1985).

Amylases include, for example, amylases described in British Patent Specification No. 1,296,839 (Novo Industries A/S), RAPIDASE®, International Bio-Synthetics, Inc. and TERMAMYL®, Novo Industries A/S.

Mannanases include the following three mannans-degrading enzymes : EC 3.2.1.25 : β-mannosidase, EC 3.2.1.78 : Endo-1,4-β-mannosidase, referred therein after as "mannanase" and EC 3.2.1.100 : 1,4-β-mannobiosidase (IUPAC Classification-Enzyme nomenclature, 1992 ISBN 0-12-227165-3 Academic Press).

More preferably, the detergent compositions of the present invention comprise a β-1,4-Mannosidase (E.C. 3.2.1.78) referred to as Mannanase. The term "mannanase" or "galactomannanase" denotes a mannanase enzyme defined according to the art as officially being named mannan endo-1,4-beta-mannosidase and having the alternative names beta-mannanase and endo-1,4-mannanase and catalysing the reaction: random hydrolysis of 1,4-beta-D-mannosidic linkages in mannans, galactomannans, glucomannans, and galactoglucomannans. In particular, Mannanases (EC 3.2.1.78) constitute a group of polysaccharases which degrade mannans and denote enzymes which are capable of cleaving polyose chains contaning mannose units, i.e. are capable of cleaving glycosidic bonds in mannans, glucomannans, galactomannans and galactoglucomannans. Mannans are polysaccharides having a backbone composed of β-1,4-linked mannose; glucomannans are polysaccharides having a backbone or more or less regularly alternating β-1,4 linked mannose and glucose; galactomannans and galactoglucomannans are mannans and glucomannans with α-1,6 linked galactose sidebranches. These compounds may be acetylated.

The cellulase enzymes used in the instant detergent composition are preferably incorporated at levels sufficient to provide up to about 5 mg by weight, more preferably about 0.01 mg to about 3 mg, of active enzyme per gram of the composition. Stated otherwise, the compositions herein preferably comprise from about 0.001% to about 5%, preferably 0.01%–1.0% by weight of a commercial enzyme preparation. The cellulase usable in the present invention includes both bacterial or fungal cellulase. Preferably, they will have a pH optimum of between 5 and 9.5. Suitable cellulases are disclosed in U.S. Pat. No. 4,435,307, Barbesgoard et al, issued Mar. 6, 1984, which discloses fungal cellulase produced from Humicola insolens and Humicola strain DSM1800 or a cellulase 212-producing microorganism belonging to the genus Aeromonas, and cellulase extracted from the hepatopancreas of a marine mollusk (Dolabella Auricula Solander). Suitable cellulases are also disclosed in GB-A-2.075.028; GB-A-2.095.275 and DE-OS-2.247.832. In addition, cellulase especially suitable for use herein are disclosed in WO 92-13057 (The Procter & Gamble Company). Most preferably, the cellulases used in the instant detergent compositions are purchased commercially from NOVO Industries A/S under the product names CAREZYME® and CELLUZYME®.

Suitable lipase enzymes for detergent usage include those produced by microorganisms of the Pseudomotnas group, such as *Pseudomonas stutzeri* ATCC 19.154, as disclosed in British Patent 1,372,034. See also lipases in Japanese Patent Application 53,20487, laid open to public inspection on Feb. 24, 1978. This lipase is available from Amano Pharmaceutical Co. Ltd., Nagoya, Japan, under the trade name Lipase P AMANO®, hereinafter referred to as "Amano-P." Other commercial lipases include AMANO-CES®, lipases from *Chromobacter viscosum*, e.g. *Chromobacter viscosum* var. lipolyticum NRRLB 3673, commercially available from Toyo Jozo Co., Tagata, Japan; and further *Chromobacter viscosum* lipases from U.S. Biochemical Corp., U.S.A. and Disoynth Co., The Netherlands, and lipases from *Pseudomonas gladioli*. The LIPOLASE® enzyme derived from Humicola lanuginosa and commercially available from Novo Industries A/S(see also EPO 341,947) is a preferred lipase for use herein.

Peroxidase enzymes are used in combination with oxygen sources, e.g., percarbonate, perborate, persulfate, hydrogen peroxide, etc. They are used for "solution bleaching," i.e. to prevent transfer of dyes or pigments removed from substrates during wash operations to other substrates in the wash solution. Peroxidase enzymes are known in the art, and include, for example, horseradish peroxidase, ligninase, and haloperoxidase such as chloro- and bromo-peroxidase. Peroxidase-containing detergent compositions are disclosed, for example, in PCT International Application WO 89/099813, published Oct. 19, 1989, by O. Kirk, assigned to Novo Industries A/S.

A wide range of enzyme materials and means for their incorporation into synthetic detergent compositions are also disclosed in U.S. Pat. No. 3,553,139, issued Jan. 5, 1971 to McCarty et al. Enzymes are further disclosed in U.S. Pat. No. 4,101,457, Place et al, issued Jul. 18, 1978, and in U.S. Pat. No. 4,507,219, Hughes, issued Mar. 26, 1985. Enzyme materials useful for liquid detergent formulations, and their incorporation into such formulations, are disclosed in U.S. Pat. No. 4,261,868, Hora et al, issued Apr. 14, 1981. Enzymes for use in detergents can be stabilized by various techniques. Enzyme stabilization techniques are disclosed and exemplified in U.S. Pat. No. 3,600,319, issued Aug. 17, 1971 to Gedge, et al, and European Patent Application Publication No. 0 199 405, Application No. 86200586.5, published Oct. 29, 1986, Venegas. Enzyme stabilization systems are also described, for example, in U.S. Pat. No. 3,519,570. Enzymes added to the compositions herein in the form of conventional enzyme prills are especially preferred for use herein. Such prills will generally range in size from about 100 to 1,000 microns, more preferably from about 200 to 800 microns and will be suspended throughout the liquid phase of the composition. Prills in the compositions of the present invention have been found, in comparison with other enzyme forms, to exhibit especially desirable enzyme stability in terms of retention of enzymatic activity over time. Thus, compositions which utilize enzyme prills need not contain conventional enzyme stabilizing such as must frequently be used when enzymes are incorporated into aqueous liquid detergents.

(c) Optional Chelating Agents

The detergent compositions herein may also optionally contain a chelating agent which serves to chelate metal ions, e.g., iron and/or manganese, within the detergent compositions herein. Such chelating agents thus serve to form complexes with metal impurities in the composition which would otherwise tend to deactivate composition components such as the peroxygen bleaching agent. Useful chelating agents can include amino carboxylates, phosphonates, amino phosphonates, polyfunctionally-substituted aromatic chelating agents and mixtures thereof.

Amino carboxylates useful as optional chelating agents include ethylenediaminetetraacetates, N-hydroxyethylethylenediaminetriacetates, nitrilotriacetates, ethylenediamine tetrapropionates, triethylenetetraaminehexacetates, diethylenetriaminepentaacetates, ethylenediaminedisuccinates and ethanol diglycines. The alkali metal salts of these materials are preferred.

Amino phosphonates are also suitable for use as chelating agents in the compositions of this invention when at least low levels of total phosphorus are permitted in detergent compositions, and include ethylenediaminetetrakis (methylene-phosphonates) as DEQUEST. Preferably, these amino phosphonates do not contain alkyl or alkenyl groups with more than about 6 carbon atoms.

Preferred chelating agents include hydroxyethyldiphosphonic acid (HEDP), diethylene triamine penta acetic acid (DTPA), ethylenediamine disuccinic acid (EDDS) and dipicolinic acid (DPA) and salts thereof. The chelating agent may, of course, also act as a detergent builder during use of the compositions herein for fabric laundering/bleaching. The chelating agent, if employed, can comprise from about 0.1% to 4% by weight of the compositions herein. More preferably, the chelating agent will comprise from about 0.2% to 2% by weight of the detergent compositions herein.

(d) Suds Suppressors

Suds suppression can be of particular importance in the present invention because of the high concentration of the detergent composition. The use of suds suppressors in "high concentration cleaning process" is described in greater detail U.S. Pat. No. 4,489,455 and 4,489,574.

A wide variety of materials may be used as suds suppressors, and suds suppressors are well known to those skilled in the art. See, for example, Kirk Othmer Encyclopedia of Chemical Technology, Third Edition, Volume 7, pages 430–447 (John Wiley & Sons, Inc., 1979). One category of suds suppressor of particular interest encompasses monocarboxylic fatty acid and soluble salts therein. See U.S. Pat. No. 2,954,347, issued Sep. 27, 1960 to Wayne St. John. The monocarboxylic fatty acids and salts thereof used as suds suppressor typically have hydrocarbyl chains of 10 to about 24 carbon atoms, preferably 12 to 18 carbon atoms. Suitable salts include the alkali metal salts such as sodium, potassium, and lithium salts, and ammonium and alkanolammonium salts.

The detergent compositions herein may also contain non-surfactant suds suppressors. These include, for example: high molecular weight hydrocarbons, N-alkylated amino triazines, monostearyl phosphates, silicone suds suppressors, secondary alcohols (e.g., 2-alkyl alkanols) and mixtures of such alcohols with silicone oils. Hydrocarbon suds suppressors are described, for example, in U.S. Pat. No. 4,265,779, issued May 5, 1981 to Gandolfo et al. Silicone suds suppressors are well known in the art and are, for example, disclosed in U.S. Pat. No. 4,265,779, issued May 5, 1981 to Gandolfo et al and European Patent Application No. 89307851.9, published Feb. 7, 1990, by Starch, M. S. Mixtures of alcohols and silicone oils are described in U.S. Pat. No. 4,798,679, 4,075,118 and EP 150,872

Additional examples of all of the aforementioned suds suppressors may be found in the provisional patent application of Pramod K. Reddy, entitled "Hydrophilic Index for Aqueous, Liquid Laundry Detergent Compositions containing LAS", filed under the Patent Cooperation having P&G Case No. 7332P, filed on Nov. 6, 1998 and having Ser. No. 60/107,477, which is hereby incorporated by reference.

The preferred particulate foam control agent used herein contains a silicone antifoam compound, an organic material and a carrier material onto which the silicone antifoam compound and the organic material are deposited. The carrier material is preferably a native starch or zeolite. The silicone antifoam compound is selected from the group consisting of polydiorganosiloxane, solid silica and mixtures thereof. Preferably, the organic material is selected from:

(a) at least one fatty acid having a carbon chain containing from 12 to 20 carbon atoms, said organic material having a melting point in the range 45° C. to 80° C. and being insoluble in water;

(b) at least one fatty alcohol, having a carbon chain containing from 12 to 20 carbon atoms, said organic material having a melting point in the range 45° C. to 80° C. and being insoluble in water;

(c) a mixture of at least one fatty acid and one fatty alcohol, each having a carbon chain containing from 12 to 20 carbon atoms, said organic material having a melting point in the range 45° C. to 80° C. and being insoluble in water;

(d) an organic material having a melting point in the range 50° C. to 85° C. and comprising a monoester of glycerol and a fatty acid having a carbon chain containing from 12 to 20 carbon atoms; and (e) a dispersing polymer; and mixtures thereof. Preferably, the dispersing polymer is selected from the group consisting of copolymers of acrylic acid and maleic acid, polyacrylates and mixtures thereof.

Silicone suds suppressors known in the art which can be used are, for example, disclosed in U.S. Pat. No. 4,265,779, issued May 5, 1981 to Gandolfo et al and European Patent Application No. 89307851.9, published Feb. 7, 1990, by Starch, M. S. Silicone defoamers and suds controlling agents in granular detergent compositions are disclosed in U.S. Pat. No. 3,933,672, Bartolotta et al, and in U.S. Pat. No. 4,652,392, Baginski et al, issued Mar. 24, 1987. An exemplary silicone based suds suppressor for use herein is a suds suppressing amount of a particulate foam control agent consisting essentially of:

(a) polydimethylsiloxane fluid having a viscosity of from about 20 cs. to about 1,500 cs. at 25° C.;

(b) from about 5 to about 50 parts per 100 parts by weight of (i) of siloxane resin composed of $(CH_3)_3SiO_{1/2}$ units of $SiO_2$ units in a ratio of from $(CH_3)_3SiO_{1/2}$ units of from about 0.6:1 to about 1.2:1; and (c) from about 1 to about 20 parts per 100 parts by weight of (i) of a solid silica gel.

Additional suds suppressor suitable for use in the present invention are described in greater detail in U.S. Pat. No. 5,762,647, issued Jun. 9, 1998, to Brown et al.

(e) Dye Transfer Inhibiting Agents and Other Fabric Care Components

The compositions of the present invention may also include one or more materials effective for inhibiting the transfer of dyes from one fabric to another during the cleaning process. These agents may be included either in the nonaqueous surfactant-containing liquid phase or in the solid particulate material.

Generally, such dye transfer inhibiting agents include polyvinyl pyrrolidone polymers, polyamine N-oxide polymers, copolymers of N-vinylpyrrolidone and N-vinylimidazole, manganese phthalocyanine, peroxidases, and mixtures thereof. These agents typically comprise from about 0.01% to about 10% by weight of the composition, preferably from about 0.01% to about 5%, and more preferably from about 0.05% to about 2%.

More specifically, the polyamine N-oxide polymers preferred for use herein contain units having the following structural formula: $R—A_x—P$; wherein P is a polymerizable unit to which an N—O group can be attached or the N—O group can form part of the polymerizable unit or the N—O group can be attached to both units; A is one of the following structures: —NC(O)—, —C(O)O—, —S—, —O—, —N=; x is 0 or 1; and R is aliphatic, ethoxylated aliphatics, aromatics, heterocyclic or alicyclic groups or any combination thereof to which the nitrogen of the N—O group can be attached or the N—O group is part of these groups. Preferred polyamine N-oxides are those wherein R is a heterocyclic group such as pyridine, pyrrole, imidazole, pyrrolidine, piperidine and derivatives thereof.

The N—O group can be represented by the following general structures:

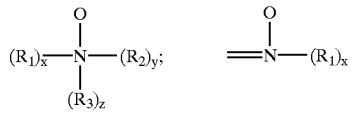

wherein $R_1$, $R_2$, $R_3$ are aliphatic, aromatic, heterocyclic or alicyclic groups or combinations thereof; x, y and z are 0 or 1; and the nitrogen of the N—O group can be attached or form part of any of the aforementioned groups. The amine oxide unit of the polyamine N-oxides has a pKa<10, preferably pKa<7, more preferred pKa<6.

Any polymer backbone can be used as long as the amine oxide polymer formed is water-soluble and has dye transfer inhibiting properties. Examples of suitable polymeric backbones are polyvinyls, polyalkylenes, polyesters, polyethers, polyamide, polyimides, polyacrylates and mixtures thereof. These polymers include random or block copolymers where one monomer type is an amine N-oxide and the other monomer type is an N-oxide. The amine N-oxide polymers typically have a ratio of amine to the amine N-oxide of 10:1 to 1:1,000,000. However, the number of amine oxide groups present in the polyamine oxide polymer can be varied by appropriate copolymerization or by an appropriate degree of N-oxidation. The polyamine oxides can be obtained in almost any degree of polymerization. Typically, the average molecular weight is within the range of 500 to 1,000,000; more preferred 1,000 to 500,000; most preferred 5,000 to 100,000.

The most preferred polyamine N-oxide useful in the detergent compositions herein is poly(4-vinylpyridine-N-oxide) which as an average molecular weight of about 50,000 and an amine to amine N-oxide ratio of about 1:4. This preferred class of materials can be referred to as "PVNO".

Further suitable dye transfer inhibitors can be found in U.S. Pat. No. 5,466,802, issued Nov. 14, 1995 to Panandiker et al., which is hereby incorporated by reference.

In addition to the dye transfer inhibitors, the present invention further comprises additional agents to provide fabric care benefits. As described above, these additional agents may be necessary because the high concentrations of detergent concentration in the aqueous laundering solutions used in the present invention may damaged the garments and fabrics contact by the aqueous laundering solutions.

Thus the present invention may also include materials which could be added to laundry products that would associate themselves with the fibers of the fabrics and textiles laundered using such products and thereby reduce or minimize the tendency of the laundered fabric/textiles to deteriorate in appearance. Any such detergent product additive material should, of course, be able to benefit fabric appearance and integrity without unduly interfering with the ability of the laundry product to perform its intended function. Such fabric appearance benefits can include, for example, improved overall appearance of the laundered fabrics, reduction of the formation of pills and fuzz, protection against color fading, improved abrasion resistance, etc.

One such fabric care agent which specifically acts to prevent dyes from migrating from the surface of a garment and into the aqueous laundering solution but also provides other fabric care benefits is 30 polyethyleneimine, PEI 600 E20, having the general formula:

$$[E_2NCH_2CH_2]_w[\overset{\overset{E}{|}}{N}CH_2CH_2]_x[\overset{\overset{B}{|}}{N}CH_2CH_2]_y NE_2$$

wherein B is a continuation by branching of the polyethyleneimine backbone. E is an ethyleneoxy unit having the formula:

$$—(CH_2CH_2O)mH$$

wherein m has an average value of about 20. What is meant herein by an average value of 20 is that sufficient ethylene oxide or other suitable reagent is reacted with the polyethyleneimine starting material to fully ethoxylate each N—H unit to a degree of 20 ethoxylations. However, those skilled in the art will realize that some N—H unit hydrogen atoms will be replaced by less than 20 ethoxy units and some will be replaced by more than 20 ethoxy units, therefore, the average of the number of ethoxylations is 20.

The units which make up the polyalkyleneimine backbones are primary amine units having the formula:

$$H_2N—CH_2CH_2]— \text{ and } —NH_2$$

which terminate the main backbone and any branching chains, secondary amine units having the formula:

$$—[\overset{\overset{H}{|}}{N}—CH_2CH_2]—$$

and which, after modification, have their hydrogen atom substituted by an average of 20 ethyleneoxy units, and tertiary amine units having the formula:

$$—[\overset{\overset{B}{|}}{N}—CH_2CH_2]—$$

which are the branching points of the main and secondary backbone chains, B representing a continuation of the chain structure by branching. The tertiary units have no replaceable hydrogen atom and are therefore not modified by substitution with ethyleneoxy units. During the formation of the polyamine backbones cyclization may occur, therefore, an amount of cyclic polyamine can be present in the parent polyalkyleneimine backbone mixture. Each primary and secondary amine unit of the cyclic alkyleneimines undergoes modification by the addition of alkyleneoxy units in the same manner as linear and branched polyalkyleneimines.

The indices w, x, and y have values such that the average molecular weight of the polyethyleneimine backbone prior to modification is about 600 daltons. In addition, those skilled in the art will recognize that each branch chain must terminate in a primary amine unit, therefore the value of the index w is y+1 in the case where no cyclic amine backbones are present. The average molecular weight for each ethylene backbone unit, $—NCH_2CH_2—$, is approximately 43 daltons.

The polyamines of the present invention can be prepared, for example, by polymerizing ethyleneimine in the presence of a catalyst such as carbon dioxide, sodium bisulfite, sulfuric acid, hydrogen peroxide, hydrochloric acid, acetic acid, etc. Specific methods for preparing these polyamine backbones are disclosed in U.S. Pat. No. 2,182,306, Ulrich et al., issued Dec. 5, 1939; U.S. Pat. No. 3,033,746, Mayle et al., issued May 8,1962; U.S. Pat. No. 2,208,095, Esselmann et al., issued Jul. 16,1940; U.S. Pat. No. 2,806,839, Crowther, issued Sep. 17,1957; and U.S. Pat. No. 2,553,696, Wilson, issued May 21,1951; all herein incorporated by reference.

Other suitable fabric care agents for use in the present detergent compositions include dye maintenance polymers. One example of such a polymer is the Adduct of Imidazole-epichlorohydrin:

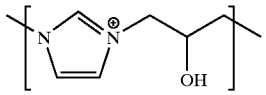

(Idealized Structure)

This has a ratio of imidazole:epichlorohydrin of 1.36:1. Further dye maintenance polymers as well as the Dye Maintenance Parameter Test are described in the copending provisional application of Rajan K. Panandiker et al., entitled "Laundry Detergent Compositions with a Cationically Charged Dye Maintenance Polymer," having P&G Case No. 7488P and Ser. No. 60/126,074, filed on Mar. 25, 1999, which is hereby incorporated by reference. As described above, these dye maintenance polymers provide overall fabric care benefits in addition to color care protection.

(f) Optional Thickening, Viscosity Control and/or Dispersing Agents

The detergent compositions herein may also optionally contain a polymeric material which serves to enhance the ability of the composition to maintain its solid particulate components in suspension. Such materials may thus act as thickeners, viscosity control agents and/or dispersing agents. Such materials are frequently polymeric polycarboxylates but can include other polymeric materials such as polyvinylpyrrolidone (PVP) or polyamide resins.

Polymeric polycarboxylate materials can be prepared by polymerizing or copolymerizing suitable unsaturated monomers, preferably in their acid form. Unsaturated monomeric acids that can be polymerized to form suitable polymeric polycarboxylates include acrylic acid, maleic acid (or maleic anhydride), fumaric acid, itaconic acid, aconitic acid, mesaconic acid, citraconic acid and methylenemalonic acid. The presence in the polymeric polycarboxylates herein of monomeric segments, containing no carboxylate radicals such as vinylmethyl ether, styrene, ethylene, etc. is suitable provided that such segments do not constitute more than about 40% by weight of the polymer.

Particularly suitable polymeric polycarboxylates can be derived from acrylic acid. Such acrylic acid-based polymers which are useful herein are the water-soluble salts of polymerized acrylic acid. The average molecular weight of such polymers in the acid form preferably ranges from about 2,000 to 100,000, more preferably from about 2,000 to 10,000, even more preferably from about 4,000 to 7,000, and most preferably from about 4,000 to 5,000. Water-soluble salts of such acrylic acid polymers can include, for example, the alkali metal, salts. Soluble polymers of this type are known materials. Use of polyacrylates of this type in detergent compositions has been disclosed, for example, Diehl, U.S. Pat. No. 3,308,067, issued Mar. 7, 1967. Such materials may also perform a builder function.

Other suitable polymeric materials suitable for use as thickening, viscosity control and/or dispersing agents include polymers of: castor oil derivatives; polyurethane derivatives, and polyethylene glycol.

If utilized, the optional thickening, viscosity control and/or dispersing agents should be present in the compositions herein to the extent of from about 0.1% to 4% by weight. More preferably, such materials can comprise from about 0.1% to 2% by weight of the detergents compositions herein.

(g) Optional Clay Soil Removal/Anti-redeposition Agents

The compositions of the present invention can also optionally contain water-soluble ethoxylated amines having clay soil removal and anti-redeposition properties. If used, soil materials can contain from about 0.01% to about 5% by weight of the compositions herein.

The most preferred soil release and anti-redeposition agent is ethoxylated tetraethylenepentamine. Exemplary ethoxylated amines are further described in U.S. Pat. No. 4,597,898, VanderMeer, issued Jul. 1, 1986. Another group of preferred clay soil removal-anti-redeposition agents are the cationic compounds disclosed in European Patent Application 111,965, Oh and Gosselink, published Jun. 27, 1984. Other clay soil removal/anti-redeposition agents which can be used include the ethoxylated amine polymers disclosed in European Patent Application 111,984, Gosselink, published Jun. 27, 1984; the zwitterionic polymers disclosed in European Patent Application 112,592, Gosselink, published Jul. 4, 1984; and the amine oxides disclosed in U.S. Pat. No. 4,548,744, Connor, issued Oct. 22, 1985. Preferred clay-removing compounds include ethoxylated quaternized amines. Preferred ethoxylated quaternized amine materials are selected from the group consisting of compounds having the general formula:

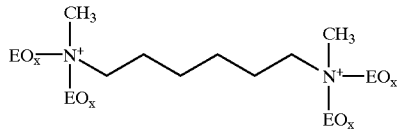

wherein each x is independently less than about 16, preferably from about 6 to about 13, more preferably from about 6 to about 8, or wherein each x is independently greater than about 35. Materials suitable for use in the present invention, such as those defined above, can be purchased from the BASF Corporation in Germany, and the Witco Chemical Company.

It has been determined that the degree of ethoxylation is important to the viscosity of the final detergent compositions described herein. Specifically, for the general structure:

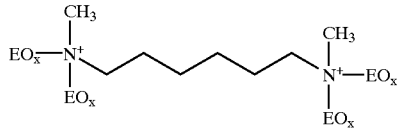

when x is less than about 13 the ethoxylated quaternized amine clay materials can be added to the present liquid heavy duty detergent compositions as liquids without causing undesired thickening at low temperatures. Likewise, when the degree of ethoxylation for the same structure is greater than about 35, that is when x is greater than about 35, these higher ethoxalated materials can be added to the formulations as stable solid without melting at high temperatures and without causing low temperature product thickening.

Of course, it will be appreciated that other, conventional optical brightener types of compounds can optionally be used in the present compositions to provide conventional fabric "brightness" benefits, rather than a true dye transfer inhibiting effect. Such usage is conventional and well-known to detergent formulations.

Other clay soil removal and/or anti-redeposition agents known in the art can also be utilized in the compositions herein. Another type of preferred anti-redeposition agent includes the carboxy methyl cellulose (CMC) materials. These materials are well known in the art.

(h) Optional Liquid Bleach Activators

The detergent compositions herein may also optionally contain bleach activators which are liquid in form at room temperature and which can be added as liquids to the liquid phase of the detergent compositions herein. One such liquid bleach activator is glycerol triacetate, which serves as a solvent in the composition during storage but when released into the wash water solution is peroxidized and functions as a bleach activator. Other examples of bleach activators include acetyl triethyl citrate (ATC) and nonanoyl valerolactam. Liquid bleach activators can be dissolved in the liquid phase of the compositions herein.

(i) Optional Brighteners. Dyes and/or Perfumes

The detergent compositions herein may also optionally contain conventional brighteners, bleach catalysts, dyes and/ or perfume materials. Such brighteners, silicone oils, bleach catalysts, dyes and perfumes must, of course, be compatible and non-reactive with the other composition components in the aqueous or non-aqueous liquid environment. If present, brighteners, dyes and/or perfumes will typically comprise from about 0.0001% to 2% by weight of the compositions herein.

(j) Structure Elasticizing Agents

The liquid detergent compositions herein can also contain from about 0.1% to 5%, preferably from about 0.1% to 2% by weight of a finely divided, solid particulate material which can include silica, e.g., fumed silica, titanium dioxide, insoluble carbonates, finely divided carbon, SD-3 bentone, clays, or combinations of these materials. Clays are well known to those skilled in the art and are commercially available from companies such as Rheox. Fine particulate material of this type functions as a structure elasticizing agent in the products of this invention. Such material has an average particle size ranging from about 7 to 40 nanometers, more preferably from about 7 to 15 nanometers. Such material also has a specific surface area which ranges from about 40 to 400m$^2$/g.

The finely divided elasticizing agent material can improve the shipping stability of the liquid detergent products herein by increasing the elasticity of the surfactant-structured liquid phase without increasing product viscosity. This permits such products to withstand high frequency vibration which may be encountered during shipping without undergoing undersirable structure breakdown which could lead to sedimentation in the product.

In the case of titanium dioxide, the use of this material also imparts whiteness to the suspension of particulate material within the detergent compositions herein. This effect improves the overall appearance of the product.

COMPOSITION FORM

As indicated, the aqueous and non-aqueous liquid detergent compositions herein are in the form of bleaching agent and/or other materials in particulate form as a solid phase suspended in and dispersed throughout a surfactant-containing, preferably structured, preferably non-aqueous liquid phase. Generally, the structured non-aqueous liquid phase will comprise from about 49% to 99.95%, more preferably from about 52% to 98.5%, by weight of the composition with the dispersed additional solid materials comprising from about 1% to 50%, more preferably from about 29% to 44%, by weight of the composition.

The particulate-containing liquid detergent compositions of this invention are substantially non-aqueous (or anhydrous) in character. While very small amounts of water may be incorporated into such compositions as an impurity in the essential or optional components, the amount of free water should in no event exceed about 1% by weight of the compositions herein. More preferably, water content of the non-aqueous detergent compositions herein will comprise less than about 1% by weight.

The particulate-containing non-aqueous liquid detergent compositions herein will be relatively viscous and phase stable under conditions of commercial marketing and use of such compositions. Frequently the viscosity of the compositions herein will range from about 300 to 8,000 cps, more preferably from about 1000 to 4,000 cps. For purposes of this invention, viscosity is measured with a Carrimed CSL2 Rheometer at a shear rate of 20 s$^{-1}$.

COMPOSITION PREPARATION AND USE

The preparation of non-aqueous liquid detergent compositions is discussed in detail in Copending application of Jay I. Kahn et al., entitled "Preparation of Nonaqueous, Particulate-Containing Liquid Detergent Compositions with Surfactant-Sturctured Liquid Phase", having P&G Case No. 6150, Ser. No. 09/202,964, filed on Dec. 23, 1998, which is hereby incorporated by reference.

An effective amount of the liquid detergent compositions herein added to water to form aqueous laundering/bleaching solutions can comprise amounts sufficient to form from about 500 to 10,000 ppm of composition in aqueous solution. More preferably, from about 800 to 8,000 ppm of the detergent compositions herein will be provided in aqueous washing/bleaching solution.

In order to make the present invention more readily understood, reference is made to the following example, which is intended to be illustrative only and not intended to be limiting in scope.

Detergent compositions made in accordance with the invention are described and exemplified below.

EXAMPLE I

A 40% solution of sodium carbonate, sodium citrate, diethylene triamine penta methyl phosphonic acid present in the ratio of 10/3/3 was prepared. Polysaccharide microspheres were then added to this solution so that the ingredients were now present in the ratio of 10/3/3/1. This solution/slurry was then passed through a spray tower equipped with a rotary atomizer operating at 22,000 RPM. The spray-tower is operating with co-current stream of hot air, an inlet temperature of approximately 240° C. and an outlet temperature of approximately 115° C. Passing the solution/slurry through the spray tower results in the formation of a low-density coated particle. The product had a pycnometer density of 0.92–1.14 g/mland a moisture content of 1%. At least 95% of the product has a particle size of between 38 m and 75 m.

The low-density coated particle was then used as a component of the following detergent composition prepared in accordance with the present invention:

| Component | Wt % Active |
|---|---|
| LAS | 16 |
| $C_{12-14}$EO = 5 alcohol ethoxylate | 22 |
| Butoxy propoxy propanol | 19 |
| Sodium citrate dihydrate | 3 |
| Coated Particle | 15 |
| EDDS | 1 |
| Cellulase Prills | 0.12 |
| Amylase Prills | 0.4 |
| Ethoxylated diamine quat | 1.25 |
| Sodium Perborate | 15.00 |
| Thickener | 0.4 |
| Suds suppressor | 0.04 |
| Perfume | 0.48 |
| Titanium dioxide | 0.5 |
| Brightener | 0.2 |
| Sulfate | 2.31 |
| TOTAL | 100.00% |

Having thus described the invention in detail, it will be clear to those skilled in the art that various changes may be made without departing from the scope of the invention and the invention is not to be considered limited to what is described in the specification.

What is claimed is:

1. A non-aqueous liquid detergent composition comprising:

A) from about 49% to about 99.95% by weight of the composition of a surfactant-containing non-aqueous liquid phase; and B) from about 1% to about 50% by weight of the composition of a suspended solid particulate phase characterized by low-density filler particles and adjuvant detersive particles wherein the low-density filler particles are substantially insoluble in said liquid phase and are substantially soluble in a wash liquor characterized by water.

2. A non-aqueous liquid detergent composition according to claim 1 wherein the low-density filler particle is insoluble in pure water.

3. A non-aqueous liquid detergent composition according to claim 2 wherein the low-density filler particle is insoluble in pure water and the wash liquor further comprises α-amylase enzymes.

4. A non-aqueous liquid detergent composition according to claim 1 wherein the adjuvant detersive particles comprise materials selected from the group consisting of peroxygen bleaching agents, bleach activators, organic detergent builders, inorganic alkalinity sources and combinations thereof.

5. A non-aqueous liquid detergent composition according claim 1 wherein the low-density filler particles have a particle size of less than 100 μm.

6. A non-aqueous liquid detergent composition according to claim 5 wherein the low-density filler particles have a density of less than 0.30 g/ml.

7. A non-aqueous liquid detergent composition according to claim 6 wherein the adjuvant detersive particles have a particle size of from about 0.1 to 1500 microns.

8. A non-aqueous liquid detergent composition according to claim 1 wherein the low-density filler particles are microspheres selected from the group consisting of protein microspheres; microspheres constructed from a three-dimensional, water-insoluble, hydrophilic, swellable, cross-linked network of polysaccharide substances, said network being degradable by α-amylase enzymes; epichlorhydrin crosslinked starch microspheres being degradable by α-amylase enzymes, and mixtures thereof.

9. A non-aqueous liquid detergent composition according to claim 1 wherein the surfactant-containing non-aqueous liquid phase has a density of from about 0.6 to 1.4 g/cc.

10. A non-aqueous liquid detergent composition according to claim 1 wherein the low-density filler particles are substantially enrobed with coating ingredients selected from the group consisting of peroxygen bleaching agents, bleach activators, bleach catalysts, an alkalinity source, a builder, a chelant, a binding agent and mixtures thereof; the detergent composition comprising one or more of the above components in the following amounts: from 5% to 95% of an alkalinity source, from 5% to 95% of a chelant, from 5% to 95% of a builder component, and from about 5% to about 95% of binding agents, and a member selected from the group consisting of peroxygen bleaching agents, bleach activators, bleach catalysts and combinations thereof.

11. A process for continuously preparing low-density coated particles according to claim 10 comprising the steps of:

(a) continuously mixing water and coating ingredients to form a solution;

(b) adding microspheres having an original average particle size of less than 100 μm to the solution to form a slurry; and (c) drying the slurry in a spray-dryer; wherein the microspheres are insoluble in water.

12. A process according to claim 11 wherein the spray-dryer is operated at an inlet temperature of from 150° C. to 500° C. and an outlet temperature of from 80° C. to 200° C.

13. A granular detergent composition comprising hollow, low-density filler particles which are substantially enrobed with granulate ingredients, the granulate ingredients being selected from the group consisting of surfactants, builders, alkalinity sources, binding agents, bleaching agents, bleach activators, suds suppressors, dye-transfer inhibitors and mixtures thereof.

* * * * *